US007299607B2

(12) United States Patent
Clüsserath et al.

(10) Patent No.: US 7,299,607 B2
(45) Date of Patent: Nov. 27, 2007

(54) BEVERAGE BOTTLING PLANT FOR FILLING BOTTLES WITH A LIQUID BEVERAGE, HAVING A FILLING ELEMENT FOR FILLING BOTTLES WITH A LIQUID BEVERAGE AND A FILLING MACHINE HAVING SUCH A FILLING ELEMENT

(75) Inventors: Ludwig Clüsserath, Bad Kreuznach (DE); Dieter-Rudolf Krulitsch, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 124 days.

(21) Appl. No.: 11/102,581

(22) Filed: Apr. 8, 2005

(65) Prior Publication Data

US 2005/0262804 A1 Dec. 1, 2005

(30) Foreign Application Priority Data

Apr. 10, 2004 (DE) ..... 10 2004 017 211

(51) Int. Cl.
*B65B 3/30* (2006.01)
*B67C 3/28* (2006.01)

(52) U.S. Cl. ..... 53/503; 53/281; 141/301

(58) Field of Classification Search ..... 53/503, 53/266.1–283; 141/301
See application file for complete search history.

(56) References Cited

U.S. PATENT DOCUMENTS

| | | | | |
|---|---|---|---|---|
| 3,529,399 | A * | 9/1970 | Schieser et al. | 53/55 |
| 4,077,182 | A * | 3/1978 | Papaluca | 53/109 |
| 4,519,184 | A * | 5/1985 | Brunswick | 53/503 |
| 4,809,485 | A * | 3/1989 | Nielsen | 53/503 |
| 5,713,403 | A * | 2/1998 | Clusserath et al. | 141/101 |
| 6,378,575 | B1 * | 4/2002 | Marchau | 141/234 |
| 6,474,368 | B2 * | 11/2002 | Clusserath et al. | 141/6 |
| 7,104,033 | B2 * | 9/2006 | Krulitsch | 53/467 |

FOREIGN PATENT DOCUMENTS

EP 658511 A1 * 6/1995

* cited by examiner

*Primary Examiner*—Stephen F. Gerrity
(74) *Attorney, Agent, or Firm*—Nils H. Ljungman & Associates

(57) ABSTRACT

A beverage bottling plant for filling bottles with a liquid beverage, having a filling element for filling bottles with a liquid beverage and a filling machine having such a filling element.

20 Claims, 7 Drawing Sheets

BEVERAGE BOTTLING PLANT FOR FILLING BOTTLES WITH A LIQUID BEVERAGE, HAVING A FILLING ELEMENT FOR FILLING BOTTLES WITH A LIQUID BEVERAGE AND A FILLING MACHINE HAVING SUCH A FILLING ELEMENT

BACKGROUND

1. Technical Field

The present application relates to a beverage bottling plant for filling bottles with a liquid beverage, having a filling element for filling bottles with a liquid beverage and a filling machine having such a filling element.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The prior art describes various filling elements for filling bottles or similar containers with a liquid to be bottled, in particular for filling bottles with beverages, including filling elements that are designed for a volume-controlled filling (volumetric filling). In these filling elements, in a liquid line between a source of the liquid being bottled (e.g. reservoir or bowl) and the respective filling element a flow meter is provided which delivers a measurement or control signal to a central control device (computer) of the filling machine that effects a termination of the filling process, i.e. the closing of the liquid valve.

OBJECT OR OBJECTS

The object is to indicate a filling element which, in a particularly compact and simplified construction of the filling machine, makes possible a volume-controlled filling of bottles or similar containers. The present application teaches that this object can be accomplished by a filling element of the type described herein below, and a filling machine with a rotary construction as described herein below.

SUMMARY

The advantages of the filling element taught by the present application, in which the flow meter is provided not externally but is integrated into each filling element, include the fact that even with a volume-controlled filling, a particularly compact construction of the overall filling machine is achieved, and in addition the number of transitions that are present and need to be sealed in the liquid duct between the reservoir or boiler and the dispensing opening of the respective filling element can be reduced.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the embodiments are disclosed herein. The embodiments are explained below with reference to the exemplary embodiments that are illustrated in the accompanying figures, in which.

DESCRIPTION OF EMBODIMENT OR EMBODIMENTS

Figure 1:
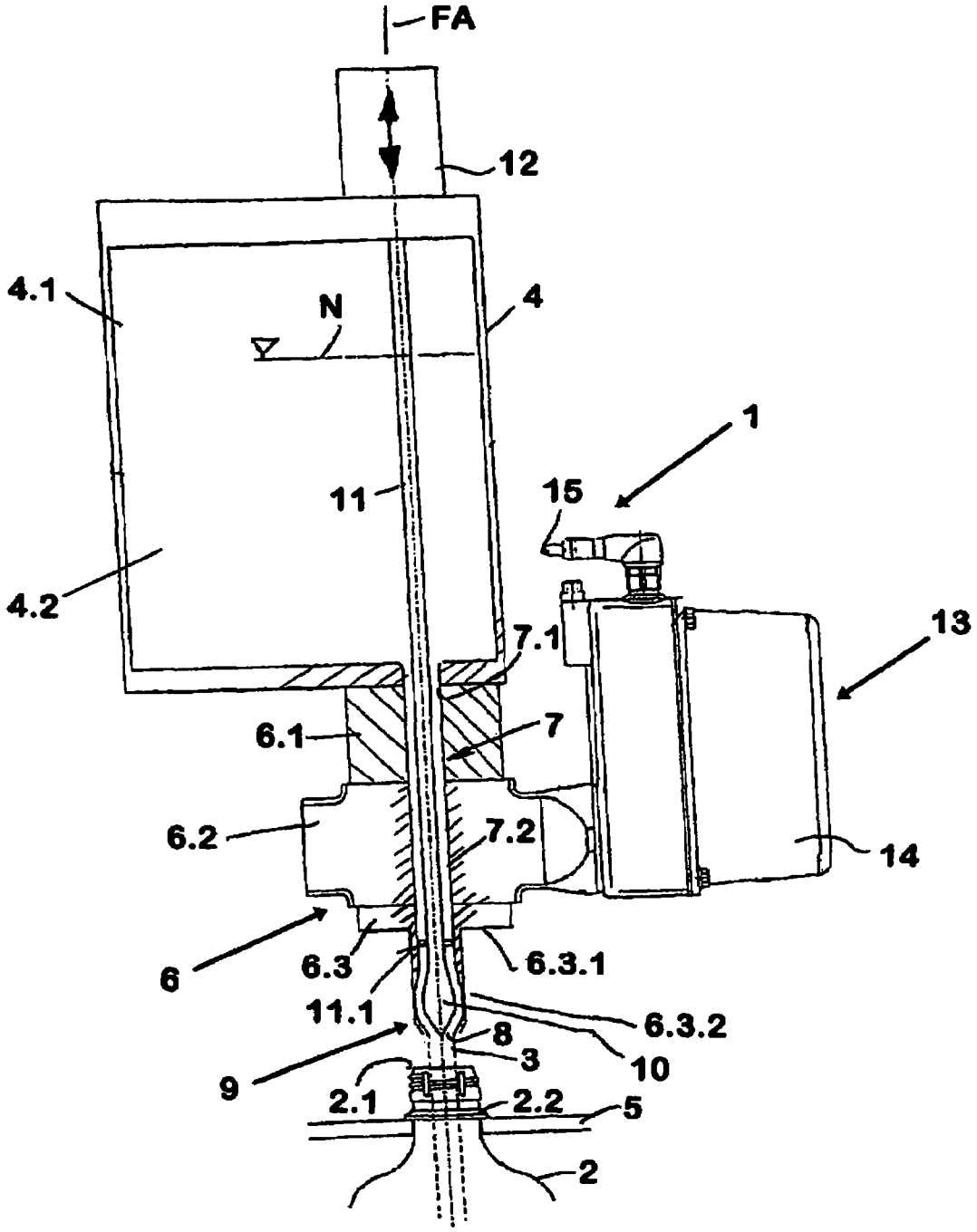
FIG. 1 is a simplified sectional drawing of a filling element of a filling machine with a rotary construction for a pressureless open-jet filling of bottles with a liquid, with the liquid valve open.
Figure 1A:
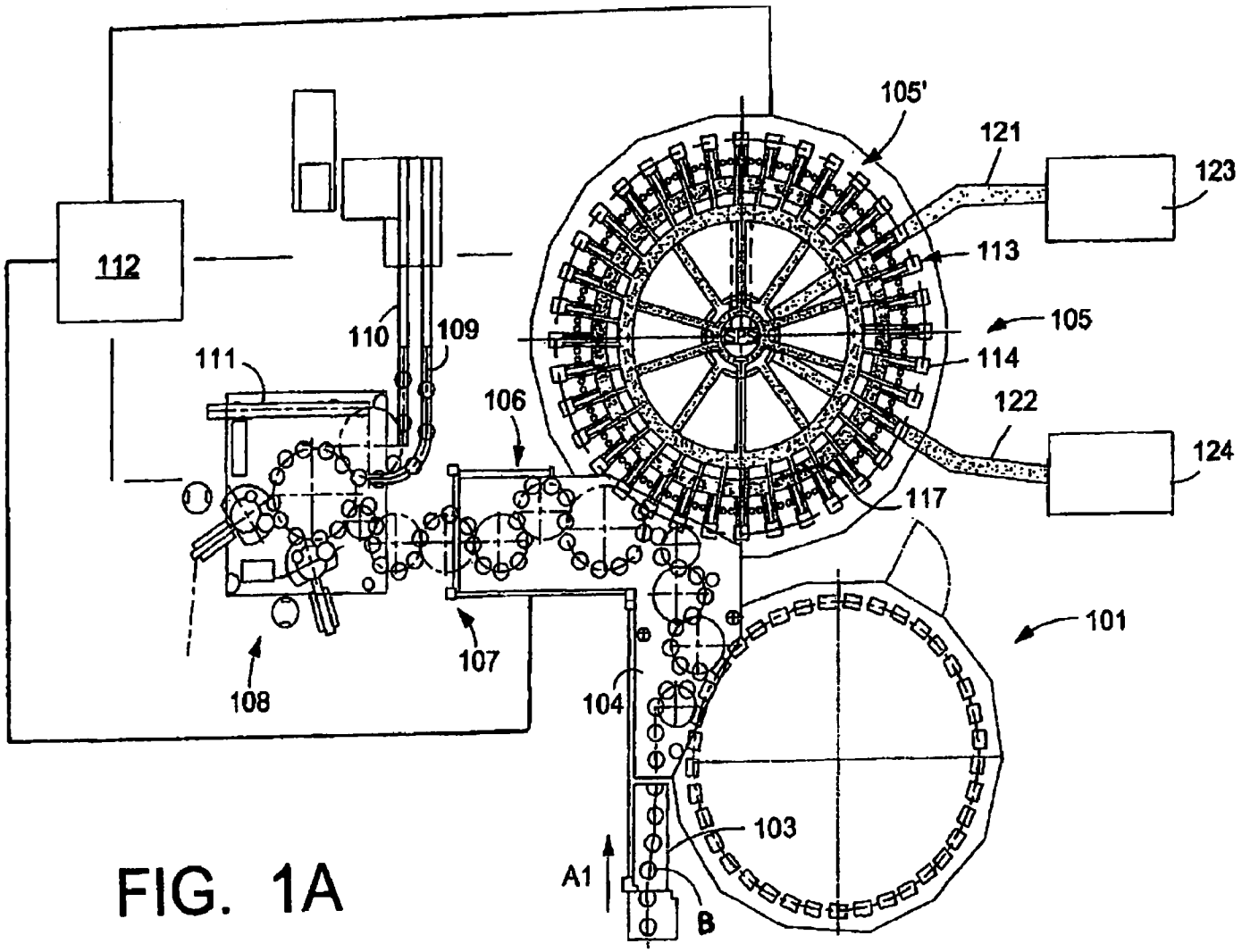
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
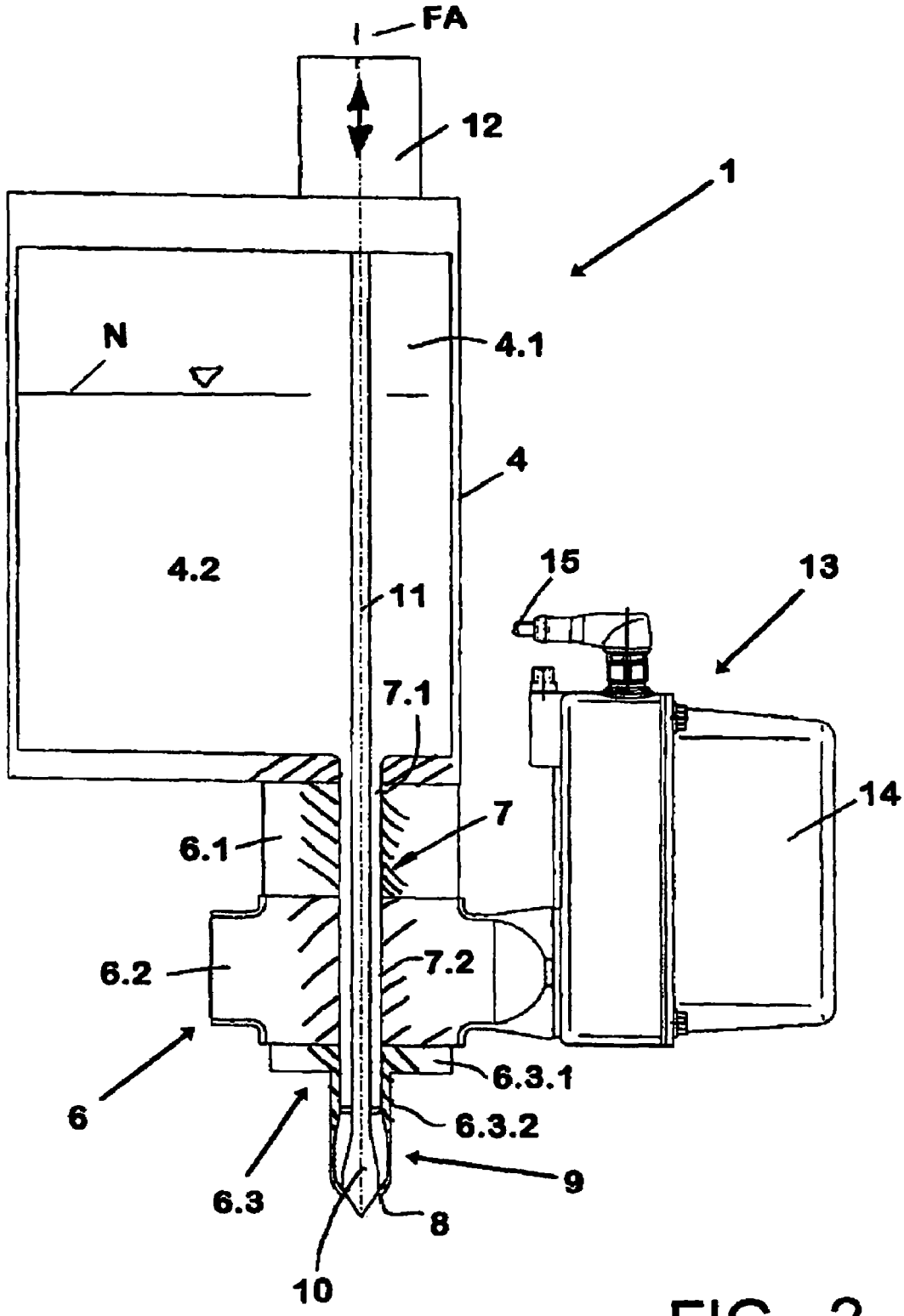
FIG. 2 is an illustration similar to FIG. 1, but with the liquid valve closed.

In FIGS. 1 and 2, 1 is a filling element for the pressureless bottling of a liquid in containers, i.e. in bottles 2, and in particular for open-jet filling, in which the bottle 2 to be filled is located with its bottle mouth 2.1 at some distance from but centered below the filling element 1, and the liquid being bottled is fed into the bottle 2 in the form of an open jet 3. The filling element 1 is provided together with a plurality of identical filling elements on the periphery of a rotor that can be driven so that it rotates around a vertical machine axis. FIGS. 1 and 2 show only a bowl 4 for the liquid being bottled and a container carrier or bottle carrier 5 on which the individual bottles 2, which in the illustrated embodiment are realized in the form of PET bottles, are suspended during the filling process in a vertical position by means of a projecting flange 2.2.

The interior of the bowl 4 is partly filled to a controlled level with the liquid to be bottled, so that above the level N of the surface of the liquid, a gas headspace 4.1 is formed which is occupied by air and/or an inert gas at atmospheric pressure, and below the level N, a liquid space 4.2 is formed which is occupied by the liquid being bottled.

The filling element 1 comprises a filling element housing 6 which, in the illustrated exemplary embodiment, is realized in three parts in the manner described below and in which the conventional liquid duct 7 is realized, which empties with its upper end in FIGS. 1 and 2 or with a connection 7.1 on its upper end directly into the liquid space 4.2, and forms a dispensing opening 8 on its lower end as shown in the figures. In the liquid duct 7, in the manner described in the prior art, there is a liquid valve 9 which comprises essentially a valve body 10 that interacts with a valve seat in the liquid duct 7, and is provided on the lower end in FIGS. 1 and 2 with an actuator rod 11. This rod can be moved by an actuator device 12 which in the illustrated embodiment is provided above the bowl 4, for example by a pneumatic piston-cylinder system with an axial stroke necessary for the opening and closing of the liquid valve 9. In the illustrated embodiment, the actuator rod 11, which can have a circular outer section, for example, is oriented in the vertical direction and with its axis defines the vertical filling element axis FA.

In the illustrated embodiment, in which the individual filling elements 1 are provided directly on the underside of the bowl 4 and the actuator rod 11 also extends through the interior of the bowl 4, the axis of the liquid channel 7 is oriented equi-axially with the axis FA. To center the actuator rod 11 in spite of its relatively great length and to center the valve body 10, a centering element 11.1 is provided in the vicinity of the lower end of the actuator rod 11, although it does not interfere with the flow of the liquid being bottled. It goes without saying that the diameter of the liquid duct 7 is greater than the outside diameter of the actuator rod 11, so that in the liquid duct 7, a ring-shaped flow path for the liquid is formed around the actuator rod 11.

As noted above, the filling element housing 6 on the illustrated exemplary embodiment comprises three parts which are connected to one another in the direction of the flow of liquid from the bowl 4 to the dispensing opening 8 in the vertical direction, and namely of the housing part 6.1 with the connection 7.1, of the housing part 6.2 which is a component of a flow meter 13 and which has the segment 7.2 of the liquid duct 7 that forms the measurement duct of said flow meter 13, and of the housing part 6.3, which is connected with its flange-like section 6.3.1 with the underside of the housing part 6.2, and transitions into a tubular section 6.3.2, which on its lower end, which is oriented equi-axially with the axis FA, forms the dispensing opening 8. Also formed in the housing part 6.3 is the valve seat for the valve body 10 of the liquid valve 9. It goes without saying that the transitions between the bowl 4 and the housing part 6.1, as well as between the housing parts 6.1-6.3, in particular in the vicinity of the liquid duct that runs through all of the housing parts, are sealed with corresponding gaskets.

As noted above, the housing part 6.2 is a component of the flow meter 13, for example of a magnetic inductive flow meter (MID), whereby on the measurement duct or section 7.2 the components (measuring unit) of the flow meter 13 that measure the flow of liquid being bottled are provided, namely on a magnetic inductive flow meter 13 at least one magnet coil to generate a magnetic field, e.g. a magnetic alternating field in the flow of liquid, as well as at least one electrode for the measurement of the electrical measurement voltage generated by the flow of liquid in the magnetic field and the quantity of liquid flowing.

As can be seen in FIG. 1, the measurement section 7.2 is located a distance from the dispensing opening 8. This distance, according to at least one possible embodiment, is approximately two, three, four, five, or six times the diameter of the dispensing opening. Consequently, the measurement section 7.2 of the flow meter 13 is located relatively closely to the dispensing opening 8.

Figure 1B:
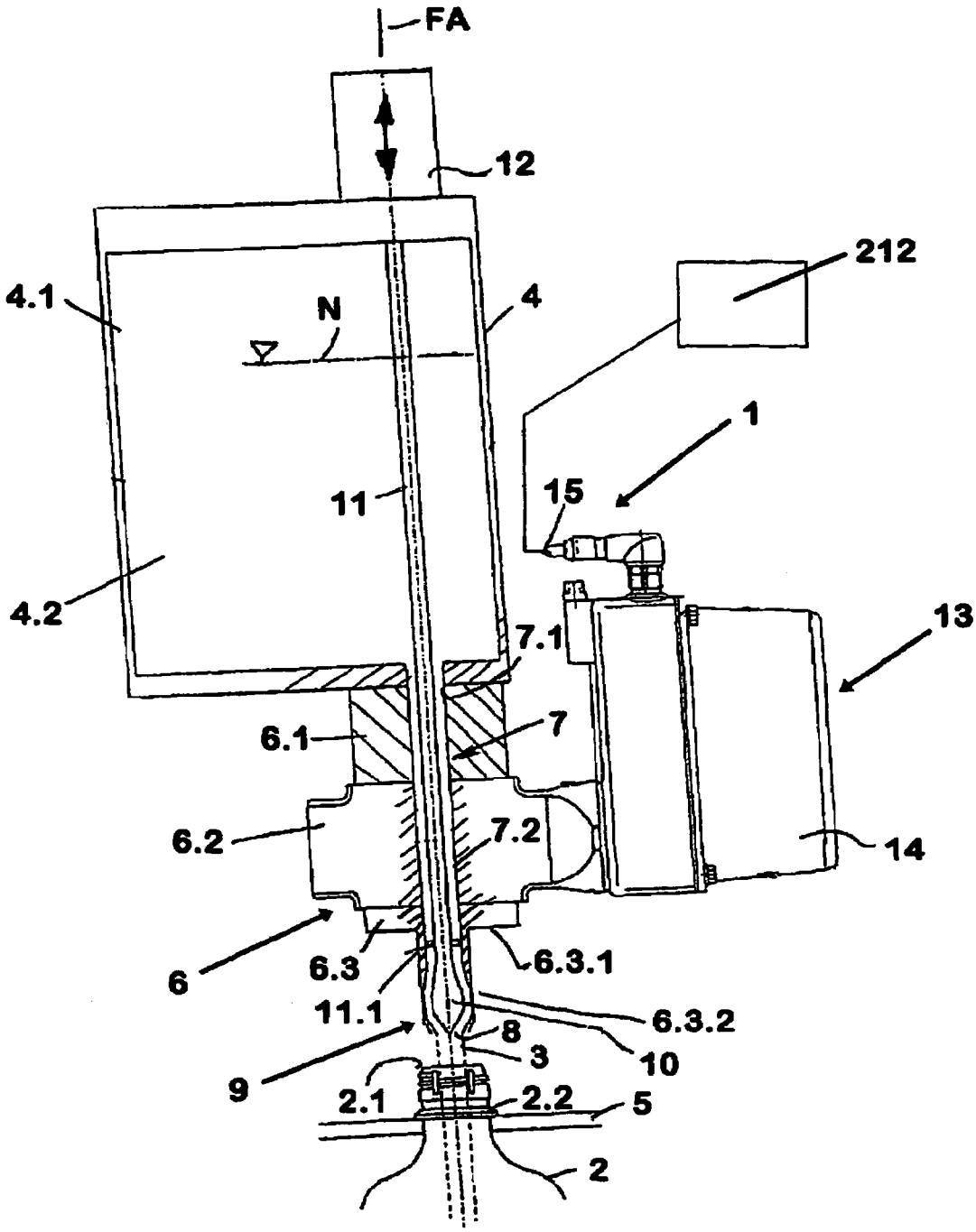
FIG. 1B shows an embodiment similar to FIG. 1 including a control unit.
Figure 2A:
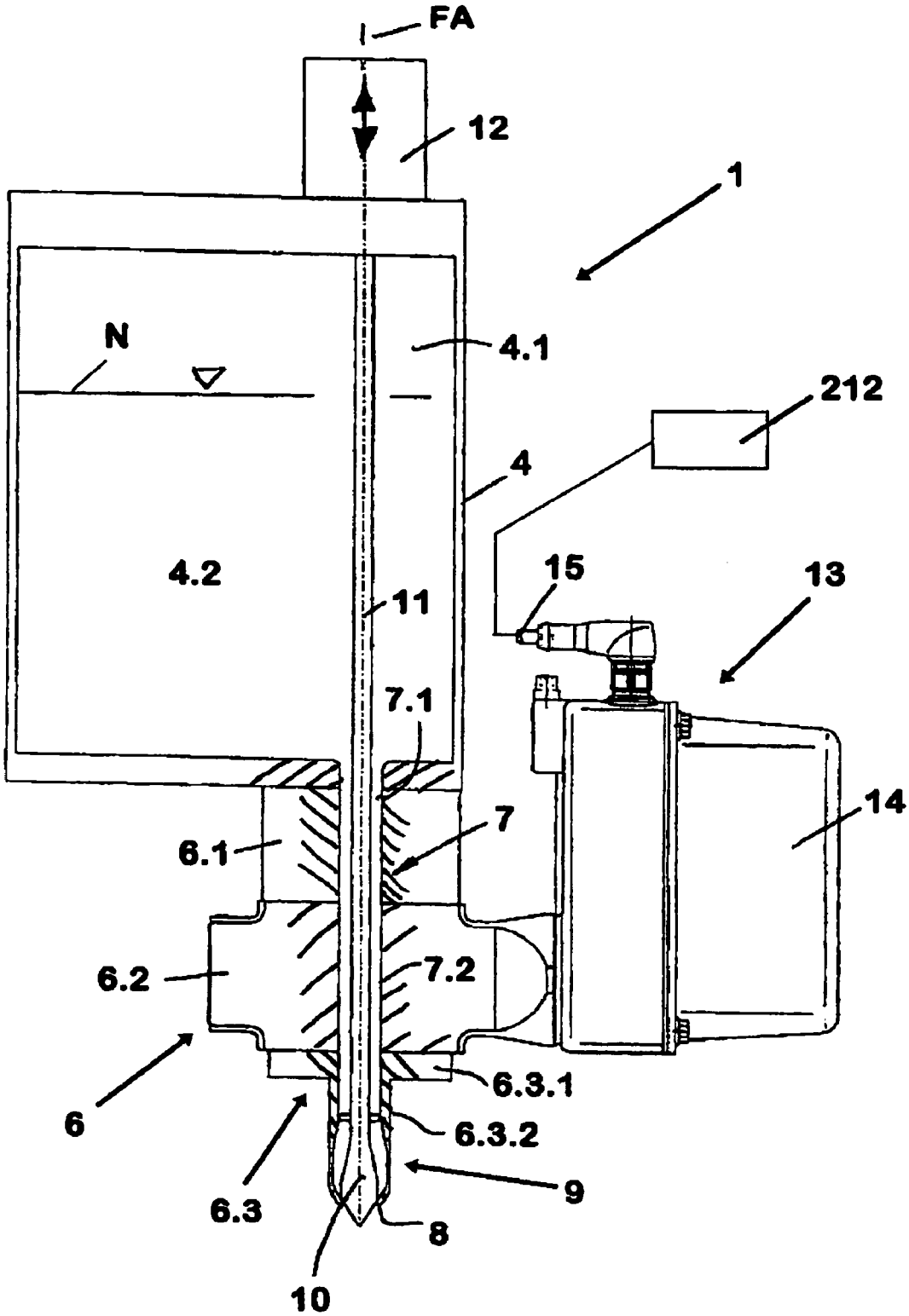
FIG. 2A shows an embodiment similar to FIG. 2 including a control unit.
Figure 3:
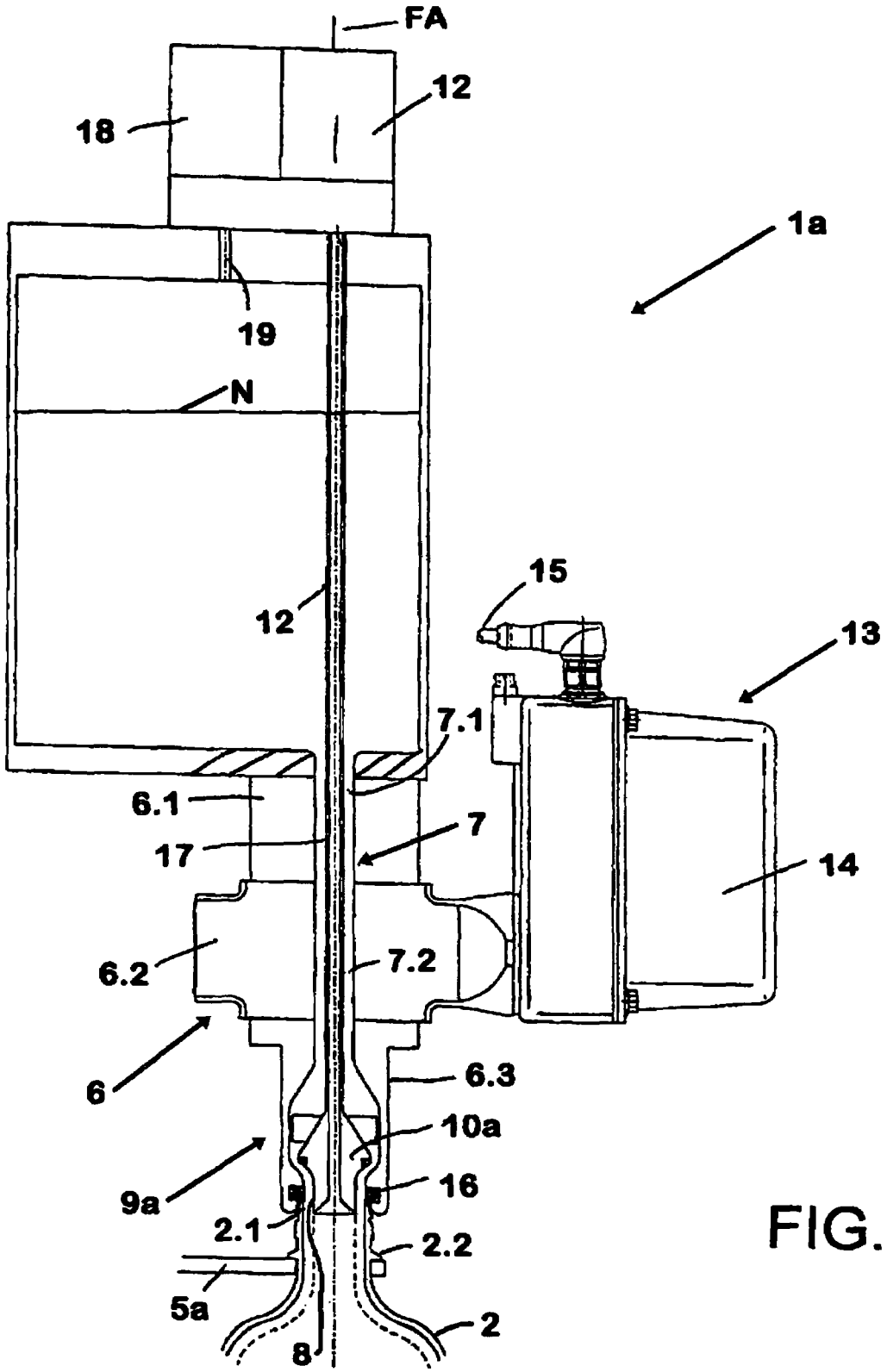
FIG. 3 is an illustration similar to FIGS. 1 and 2 and shows a filling element of a filling machine with a rotary construction for a pressure filling of bottles with a liquid.
Figure 3A:
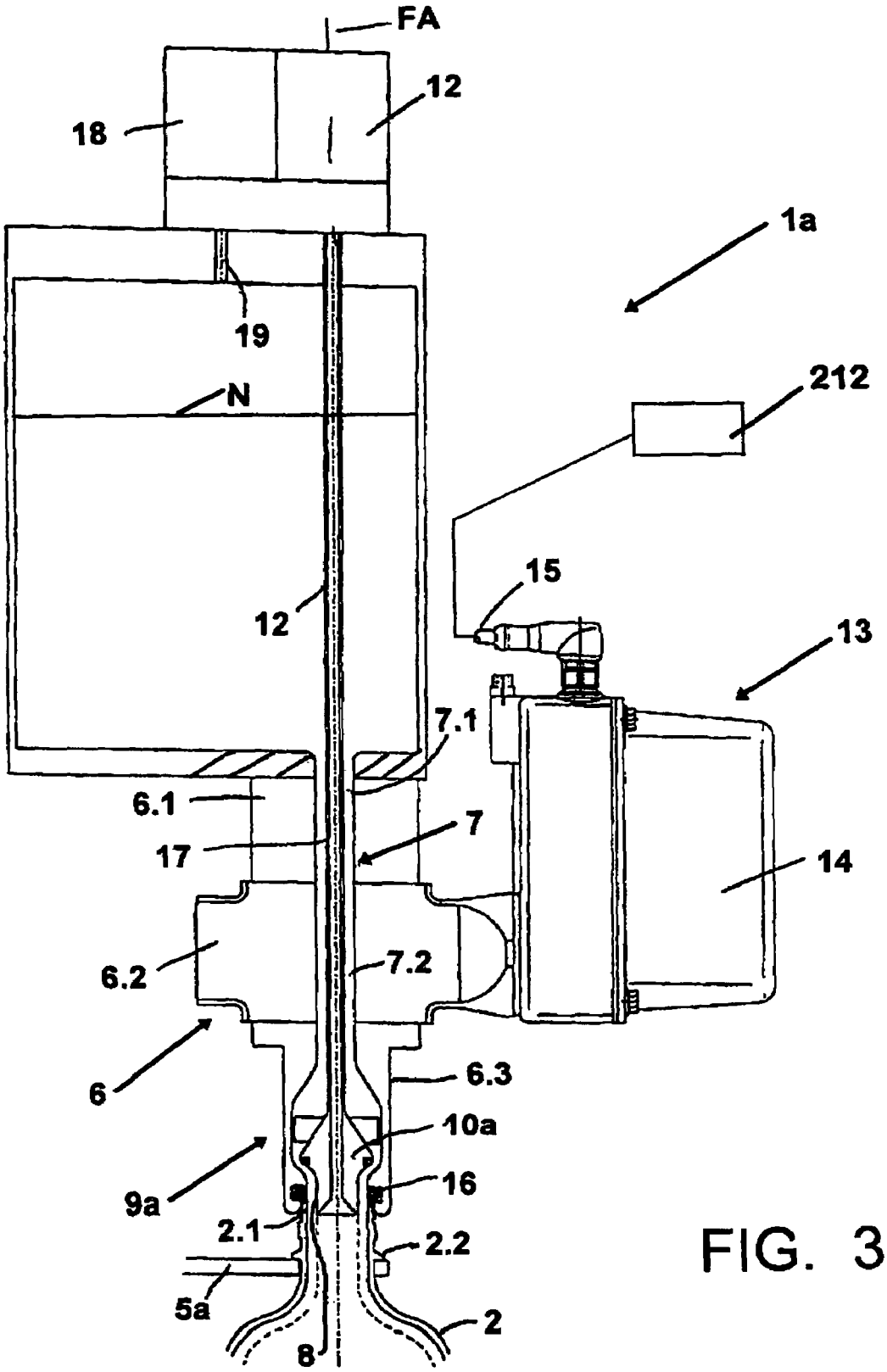
FIG. 3A shows an embodiment similar to FIG. 3 including a control unit.

On the housing part 6.2, out the outside in a housing 14 are the additional electrical components, for example the electronic actuation and measurement equipment of the flow meter 13, among other things to actuate the magnetic coil and to evaluate the measurement voltage and to form a measurement signal that is supplied via a connecting line 15 to a central control unit or computer 212 of the filling machine (see FIGS. 1B, 2A, 3A).

If the flow meter 13 is realized in the form of a magnetic inductive flow meter, the actuator rod 11 is made, at least on the portion of its length that runs through the housing part 6.2, of an electrically non-conducting material, preferably one that is also not ferromagnetic, such as plastic, for example, and/or glass and/or ceramic.

The diameter of the liquid duct 7 and the outside diameter of the actuator rod 11 are constant in the section 7.2, so that the flow cross section for the liquid in the measurement duct or section 7.2 does not vary with the stroke of the actuator rod 11, as a result of which a high degree of measurement accuracy is achieved.

The bottles 2 are filled with the filling element 1 and with the filling machine that has these filling elements 1 in the manner described in the prior art for open-jet filling systems with volume control, i.e. after the inlet and positioning of the bottles 2 on the bottle carrier 5 underneath the respective filling element 1, its liquid valve 9 is opened to initiate the filling process. The filling process is terminated by closing the liquid valve 9, and namely controlled by the signal supplied by the flow meter 13.

FIG. 3 shows, as an additional possible exemplary embodiment, a filling element 1*a* which is in turn provided together with a plurality of identical filling elements on the rotor which can be driven in rotation around a vertical machine axis, and namely in the illustrated exemplary embodiment directly on the underside of the bowl 4. The filling element 1*a* differs functionally from the filling element 1 essentially only in that the filling element 1*a* can be used for a pressure filling, i.e. a filling of the bottles 2 under pressure. To the extent that parts of the filling element 1*a* are the same as parts of the filling element 1, at least functionally, they are identified with the same reference numbers in FIG. 3 as in FIGS. 1 and 2.

Accordingly, the filling element 1*a* differs constructively from the filling element 1 in that, among other things, instead of a bottle carrier 5 there is a bottle carrier 5*a*, which can be moved up and down in the direction of the filling element axis FA by a reciprocating device (not shown), and specifically to raise the bottles 2 to be filled so that their bottle mouth 2.1 is in sealed contact against the respective filling element 1*a*, and to lower the filled bottles 2. In the vicinity of the dispensing opening 8 there is a gasket 16 that surrounds said opening, against which the respective bottle 2 is in sealed contact with its bottle mouth 2.1 during the filling. Instead of the liquid valve 9, a liquid valve 9*a* is provided, and specifically with a valve body 10*a* that interacts with a valve seat of the liquid duct 7, which valve body 10*a* is provided on the lower end of a return gas tube 17. Said tube is oriented equi-axially with the axis FA and interacts with its upper end with the actuator element 12, and specifically for an axial travel necessary to open and close the liquid valve 9*a*.

The return gas tube 17 extends in a manner similar to the actuator rod 11 through the entire liquid duct 7 and through the interior of the bowl 4, which in turn is filled to a controlled level with the liquid being bottled (up to the level N). The gas headspace 4.1, however, is in any case pressurized during the filling process with an inert gas under pressure, e.g. CO2 gas. The return gas duct realized in the return gas tube 17 is in communication with a gas duct 19 that has a control valve 18, which gas duct 19 empties into the gas headspace 4.1, so that by an appropriate actuation of the liquid valve 9*a*, of the control valve 18 and optionally of an additional control valve not shown but located in a gas duct, a pressure filling, i.e. a single-chamber pressure filling, for example, is possible, in which the bottle 2 (optionally after a preliminary rinsing) in sealed contact with the filling element 1*a* is tempered or pre-pressurized with the inert gas from the gas headspace 4.1 by controlled opening of the control valve 18, and the filling is initiated by opening the liquid valve 9. In response to the signal supplied by the flow meter 13, the filling is then terminated in a controlled manner by closing the liquid valve 9*a*. The depressurization at the end of the filling process and/or the initiation of a high-speed or low-speed filling is then effected by the additional control valve (not shown), which is provided separately for each filling element 1*a*, as are the actuator element 12 and the control valve 18.

On the filling element 1*a*, the return gas tube 17 also runs through the housing part 6.2 or through the section 7.2 that forms the measurement duct of the flow meter 13. At least in the area of the housing part 6.2, the liquid duct 7 and the return gas tube 13 are realized so that the effective flow cross section in section 7.2 is not changed as a result of the axial travel of the return gas tube 17, and thus an accurate and precise measurement of volume is guaranteed.

On the other hand, if the flow meter 13 is realized in the form of a magnetic inductive flow meter, the return gas tube is made, at least on the portion of its length that runs through the housing part 6.2, of an electrically non-conducting material, preferably of a non-ferromagnetic material, such as glass and/or plastic, for example, such as fiber-reinforced plastic, and/or ceramic.

One unique feature of the filling element 1 or 1*a* and of the corresponding filling machine is that the flow meter 13 is integrated with its measuring unit and the additional components into the filling element 1, and specifically such that the actuator rod 11 or the return gas tube 17 also extend through the housing part 6.2 or through the section 7.2 located there. As a result, on one hand there is a very compact construction, even for a volumetric control. On the other hand, with this construction the number of transitions that must be sealed in the liquid duct between the bowl 4 and the dispensing opening 8 can be reduced.

The embodiments have been described above with reference to exemplary embodiments. It goes without saying that modifications and variations can be made without thereby going beyond the basic teaching of the present application.

The present application relates to a filling element for filling bottles or similar containers with a liquid, to control the filling process as a function of a signal from a flow meter that is located in the flow path of the liquid being bottled, said flow meter is integrated into the filling element.

One feature or aspect of an embodiment is believed at the time of the filing of this patent application to possibly reside broadly in a filling element for filling bottles or similar containers with a liquid, with a liquid duct realized in a housing of the filling element, which liquid duct forms a connection with a source for the liquid to be bottled and a dispensing opening for dispensing the liquid into a container to be filled, and between the connection and the dispensing opening has a liquid valve with a valve body that interacts with a valve seat, which valve body can be moved by a specified distance by an actuator element for an opening and closing of the liquid valve and specifically for a control of the filling process as a function of a signal from a flow meter that is located in the flow path of the liquid being bottled, characterized by a measuring unit of the flow meter that measures the flow volume of the liquid in the filling element housing on a section of the liquid duct that forms a measurement duct.

Another feature or aspect of an embodiment is believed at the time of the filing of this patent application to possibly reside broadly in a filling element, characterized by the fact that in a multi-part realization of the filling element housing, the measuring unit of the flow meter that measures the flow of the liquid being bottled is provided in at least one part of this housing.

Yet another feature or aspect of an embodiment is believed at the time of the filing of this patent application to possibly reside broadly in a filling element, characterized by the fact that the measuring unit of the flow meter that measures the flow of the liquid being bottled is located in the liquid duct between the connection and the liquid valve.

Still another feature or aspect of an embodiment is believed at the time of the filing of this patent application to possibly reside broadly in filling element, characterized by the fact that the liquid valve and/or the valve body are actuated by means of a tappet and that the tappet extends through the section of the liquid duct that forms the measurement duct of the flow meter.

A further feature or aspect of an embodiment is believed at the time of the filing of this patent application to possibly reside broadly in a filling element, characterized by the fact that the filling element can be fastened to an underside of a bowl that forms the source for the liquid to be bottled, and that the actuator tappet is also extended through the interior of the bowl and interacts with the actuator element on its end farther from the filling element.

Another feature or aspect of an embodiment is believed at the time of the filing of this patent application to possibly reside broadly in a filling element, characterized by the fact that the actuator element is a pneumatic actuator element.

Yet another feature or aspect of an embodiment is believed at the time of the filing of this patent application to possibly reside broadly in a filling element, characterized by the fact that the tappet is an actuator rod.

Still another feature or aspect of an embodiment is believed at the time of the filing of this patent application to possibly reside broadly in a filling element, characterized by the fact that the tappet is a return gas tube which is a component of at least one gas path that preferably has at least one control valve.

A further feature or aspect of an embodiment is believed at the time of the filing of this patent application to possibly reside broadly in a filling element, characterized by the fact that the liquid duct and the tappet have a constant or essentially constant inside and/or outside diameter at least in the section that functions as the measurement duct.

Another feature or aspect of an embodiment is believed at the time of the filing of this patent application to possibly reside broadly in a filling element, characterized by the fact that the tappet is made of an electrically non-conducting material, for example glass and/or plastic, e.g. fiber-reinforced plastic and/or ceramic at least on its partial length that runs through the measurement duct of the flow meter.

Yet another feature or aspect of an embodiment is believed at the time of the filing of this patent application to possibly reside broadly in a filling element, characterized by the fact that the liquid duct is realized in a straight line or essentially in a straight line between the connection and the dispensing opening, preferably equi-axially with the axis of the tappet.

Still another feature or aspect of an embodiment is believed at the time of the filing of this patent application to possibly reside broadly in a filling machine with a rotary construction, with a plurality of filling elements provided on a rotor that can be driven in rotation around a machine axis, characterized by the fact that the filling elements are realized as recited in one of the preceding claims.

Some examples of inductive flow meters, such as magnetic inductive flow meters, which may possibly be adapted for use in at least one possible embodiment, may possibly be found in the following U.S. Pat. No. 5,808,208 entitled "Inductive flow meter;" U.S. Pat. No. 5,641,914 entitled "Inductive flow meter;" U.S. Pat. No. 5,121,640 entitled "Electromagnetic flow meter;" U.S. Pat. No. 4,972,722 entitled "Magnetic inductive flow meter;" and U.S. Pat. No. 4,522,073 entitled "Magnetic-inductive flow meter for high temperatures."

The components disclosed in the various publications, disclosed or incorporated by reference herein, may possibly be used in possible embodiments of the present invention, as well as equivalents thereof.

Some examples of bottling and container handling systems and components thereof which may possibly be utilized or adapted for use in at least one possible embodiment, may possibly be found in the following U.S. Pat. No.

6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

The appended drawings in their entirety, including all dimensions, proportions and/or shapes in at least one embodiment of the invention, are accurate and are hereby included by reference into this specification.

Some examples of bottling and container handling systems and components thereof which may possibly be utilized or adapted for use in at least one possible embodiment, may possibly be found in the following U.S. patent application Ser. No. 10/653617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666931, filed on Sep. 18, 2003, entitled "Beverage Bottling Plant for Filling Bottles with a Liquid Beverage Filling Material and a Labelling Station for Filled Bottles and Other Containers;" Ser. No. 10/723451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786256, entitled "A Beverage Bottling Plant for Filling Bottles with a Liquid Beverage Filling Material, and a Container Filling Lifting Device for Pressing Containers to Container Filling Machines;" Ser. No. 10/793659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939170, filed on Sep. 10, 2004, Ser. No. 10/954012, filed on Sep. 29, 2004, Ser. No. 10/952706, filed on Oct. 8, 2004, Ser. No. 10/967016, filed on Oct. 15, 2004, Ser. No. 10/982706, filed on Nov. 5, 2004, Ser. No. 10/982694, Ser. No. 10/982710, Ser. No. 10/984677, filed on Nov. 9, 2004, Ser. No. 10/985640, filed on Nov. 10, 2004, No. 11/004663, filed on Dec. 3, 2004, Ser. No. 11/009551, filed on Dec. 10, 2004, Ser. No. 11/012859, filed on Dec. 15, 2004, Ser. No. 11/014673, filed on Dec. 16, 2004, Ser. No. 11/016364, filed on Dec. 17, 2004, and Ser. No. 11/016363.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The sentence immediately above relates to patents, published patent applications and other documents either incorporated by reference or not incorporated by reference.

The corresponding foreign and international patent publication applications, namely, Federal Republic of Germany Patent Application No. 10 2004 017 211.0, filed on Apr. 10, 2004, having inventors Ludwig CLÜSSERATH and Dieter-Rudolf KRULITSCH, and DE-OS 10 2004 017 211.0 and DE-PS 10 2004 017 211.0, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

| AT LEAST PARTIAL LIST OF TERMS | |
|---|---|
| 1, 1a | Filling element |
| 2 | Bottle |
| 2.1 | Bottle mouth |
| 2.2 | Flange on the bottle neck |
| 3 | Jet of liquid being bottled |
| 4 | Bowl |
| 4.1 | Gas headspace |
| 4.2 | Liquid space |
| 5, 5a | Bottle carrier |
| 6 | Filling element housing |
| 6.1, 6.2, 6.3 | Housing part |
| 6.3.1 | Flange-like section |
| 6.3.2 | Tubular section |
| 7 | Liquid duct |
| 7.1 | Connection |
| 7.2 | Section or measurement duct |
| 8 | Dispensing opening |
| 9, 9a | Liquid valve |
| 10, 10a | Valve body |
| 11 | Actuator rod |
| 11.1 | Centering element on actuator rod |
| 12 | Actuator element |
| 13 | Flow meter |
| 14 | Housing |
| 15 | Control line |
| 16 | O-ring on dispensing opening 8 |

-continued

| AT LEAST PARTIAL LIST OF TERMS | |
|---|---|
| 17 | Return gas tube |
| 18 | Control valve |
| 19 | Gas duct |
| FA | Vertical filling element axis |
| N | Liquid level in the bowl 4 |

What is claimed is:

1. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a rotary beverage filling machine being configured and disposed to fill beverage bottles with liquid beverage material;

said beverage filling machine comprising a rotor having a central vertical axis about which said rotor is rotated;

said beverage filling machine comprising a plurality of beverage filling elements for filling beverage bottles with liquid beverage material disposed on the periphery of said rotor;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

said beverage filling machine comprising a reservoir being configured and disposed to contain a supply of liquid beverage material;

each of said beverage filling elements being configured and disposed to control dispensing of liquid beverage material from said reservoir into bottles; and each of said beverage filling elements comprising:

a liquid duct being configured and disposed to permit flow of liquid beverage material from said reservoir into bottles;

a first housing structure being configured and disposed to form a first portion of said liquid duct, said first portion being connected to said reservoir;

a second housing structure being configured and disposed to form a second portion of said liquid duct;

said second housing structure comprising a dispensing opening;

a liquid valve comprising a valve body being disposed in said second portion of said liquid duct;

said second housing structure comprising a valve seat disposed adjacent said valve body;

said liquid valve comprising an actuator element being connected to said valve body;

said actuator element being configured and disposed to axially move said valve body into and out of sealing engagement with said valve seat to close and open said liquid valve to control flow of liquid beverage out of said dispensing opening;

a flow meter being configured and disposed to monitor flow of liquid beverage material in said liquid duct;

said liquid valve being operatively connected to said flow meter and being configured to be opened or closed according to the flow of liquid beverage material detected by said flow meter;

a third housing structure being configured and disposed to form a third portion of said liquid duct;

said third housing structure being disposed between and to connect said first housing structure and said second housing structure; and said flow meter comprising a measuring unit being integrated in said third housing structure.

2. The beverage bottling plant according to claim 1, wherein:

each of said beverage filling elements comprises a tappet disposed to extend through said third housing structure of said liquid duct; and said valve body is operatively connected to said actuator element by said tappet to permit opening and closing of said liquid valve.

3. The beverage bottling plant according to claim 2, wherein:

said reservoir comprises a bowl;

said filling element is configured to be fastened to an underside of said bowl; and said tappet is disposed to extend through the interior of said bowl.

4. The beverage bottling plant according to claim 3, wherein said actuator element comprises a pneumatic actuator element.

5. The beverage bottling plant according to claim 4, wherein said tappet comprises an actuator rod.

6. The beverage bottling plant according to claim 5, wherein said liquid duct and said tappet each have a constant or essentially constant inside and/or outside diameter at least in said third housing structure.

7. The beverage bottling plant according to claim 6, wherein:

said tappet is made of an electrically non-conducting material comprising at least one of: glass, plastic, fiber-reinforced plastic, and ceramic, at least on its partial length that runs through said third housing structure; and said liquid duct is disposed to run essentially in a straight line between said first portion and said second portion thereof equi-axially with the axis of said tappet.

8. The beverage bottling plant according to claim 4, wherein said tappet comprises a return gas tube which is a component of at least one gas path that comprises at least one control valve.

9. The beverage bottling plant according to claim 8, wherein said liquid duct and said tappet each have a constant or essentially constant inside and/or outside diameter at least in said third housing structure.

10. The beverage bottling plant according to claim 9, wherein:

said tappet is made of an electrically non-conducting material comprising at least one of: glass, plastic, fiber-reinforced plastic, and ceramic, at least on its partial length that runs through said third housing structure; and said liquid duct is disposed to run essentially in a straight line between said first portion and said second portion thereof equi-axially with the axis of said tappet.

11. A rotary beverage filling machine for filling beverage bottles with liquid beverage material in a beverage bottling plant, said beverage filling machine comprising:

a rotor having a central vertical axis about which said rotor is rotated;

a plurality of beverage filling elements for filling beverage bottles with liquid beverage material disposed on the periphery of said rotor;

a reservoir being configured and disposed to contain a supply of liquid beverage material;

each of said beverage filling elements being configured and disposed to control dispensing of liquid beverage material from said reservoir into bottles; and each of said beverage filling elements comprising:

a liquid duct being configured and disposed to permit flow of liquid beverage material from said reservoir into bottles;

a first housing structure being configured and disposed to form a first portion of said liquid duct, said first portion being connected to said reservoir;

a second housing structure being configured and disposed to form a second portion of said liquid duct;

said second housing structure comprising a dispensing opening;

a liquid valve comprising a valve body being disposed in said second portion of said liquid duct;

said second housing structure comprising a valve seat disposed adjacent said valve body;

said liquid valve comprising an actuator element being connected to said valve body;

said actuator element being configured and disposed to axially move said valve body into and out of sealing engagement with said valve seat to close and open said liquid valve to control flow of liquid beverage out of said dispensing opening;

a flow meter being configured and disposed to monitor flow of liquid beverage material in said liquid duct;

said liquid valve being operatively connected to said flow meter and being configured to be opened or closed according to the flow of liquid beverage material detected by said flow meter;

a third housing structure being configured and disposed to form a third portion of said liquid duct;

said third housing structure being disposed between and to connect said first housing structure and said second housing structure; and said flow meter comprising a sensing unit being integrated in said third housing structure.

12. The rotary beverage filling machine according to claim 11, wherein:

each of said beverage filling elements comprises a tappet disposed to extend through said third housing structure of said liquid duct; and said valve body is operatively connected to said actuator element by said tappet to permit opening and closing of said liquid valve.

13. The rotary beverage filling machine according to claim 12, wherein:

said reservoir comprises a bowl;

said filling element is configured to be fastened to an underside of said bowl; and said tappet is disposed to extend through the interior of said bowl.

14. The rotary beverage filling machine according to claim 13, wherein said actuator element comprises a pneumatic actuator element.

15. The rotary beverage filling machine according to claim 14, wherein said tappet comprises an actuator rod.

16. The rotary beverage filling machine according to claim 15, wherein said liquid duct and said tappet each have a constant or essentially constant inside and/or outside diameter at least in said third housing structure.

17. The rotary beverage filling machine according to claim 16, wherein:

said tappet is made of an electrically non-conducting material comprising at least one of: glass, plastic, fiber-reinforced plastic, and ceramic, at least on its partial length that runs through said third housing structure; and said liquid duct is disposed to run essentially in a straight line between said first portion and said second portion thereof equi-axially with the axis of said tappet.

18. The rotary beverage filling machine according to claim 14, wherein said tappet comprises a return gas tube which is a component of at least one gas path that comprises at least one control valve.

19. The rotary beverage filling machine according to claim 18, wherein said liquid duct and said tappet each have a constant or essentially constant inside and/or outside diameter at least in said third housing structure.

20. The rotary beverage filling machine according to claim 19, wherein:

said tappet is made of an electrically non-conducting material comprising at least one of: glass, plastic, fiber-reinforced plastic, and ceramic, at least on its partial length that runs through said third housing structure; and said liquid duct is disposed to run essentially in a straight line between said first portion and said second portion thereof equi-axially with the axis of said tappet.

* * * * *